US007257920B1

(12) United States Patent
Shaffer et al.

(10) Patent No.: US 7,257,920 B1
(45) Date of Patent: Aug. 21, 2007

(54) AIMING DEVICE

(75) Inventors: Brian K. Shaffer, Waldorf, MD (US); Paul Fennewald, California, MO (US); John Monico, Fredericksburg, VA (US); Richard Higgins, Arlington, VA (US); James Waldron, Bethesda, MD (US)

(73) Assignee: The United Stated of America as Represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/816,577

(22) Filed: Mar. 26, 2004

(51) Int. Cl.
*F41A 3/00* (2006.01)

(52) U.S. Cl. ..... 42/118; 42/111; 42/135

(58) Field of Classification Search ..... 42/135, 42/118, 119, 120, 111
See application file for complete search history.

(56) References Cited

U.S. PATENT DOCUMENTS

| | | | | | |
|---|---|---|---|---|---|
| 40,256 | A * | 10/1863 | Garretson | 42/111 |
| 187,432 | A * | 2/1877 | Totten | 356/153 |
| 880,378 | A * | 2/1908 | Geis | 356/254 |
| 1,176,893 | A * | 3/1916 | Hartney | 356/254 |
| 1,227,544 | A * | 5/1917 | Lobdell | 356/255 |
| 1,264,133 | A * | 4/1918 | Morris | 42/118 |
| 2,331,616 | A * | 10/1943 | Minghetti | 356/255 |
| 2,391,659 | A * | 12/1945 | Trafford | 359/403 |
| 2,412,298 | A * | 12/1946 | Siazik | 356/254 |
| 3,262,440 | A * | 7/1966 | Kuhn | 124/67 |
| 3,863,354 | A * | 2/1975 | Karppinen | 42/118 |
| 3,912,400 | A * | 10/1975 | Luebkeman | 356/247 |
| 3,966,298 | A * | 6/1976 | Chapman | 359/401 |
| 4,084,326 | A * | 4/1978 | Numbers | 42/122 |
| 4,108,551 | A * | 8/1978 | Weber | 356/4.01 |
| 5,050,962 | A | 9/1991 | Monnier et al. | 359/13 |
| 5,369,888 | A | 12/1994 | Kay et al. | 33/241 |
| 5,373,644 | A | 12/1994 | Depaoli | 33/241 |
| 5,383,278 | A | 1/1995 | Kay | 33/265 |
| 5,483,362 | A | 1/1996 | Tai et al. | 359/1 |
| 5,653,034 | A * | 8/1997 | Bindon | 42/131 |
| 6,154,313 | A * | 11/2000 | Isbell et al. | 359/419 |
| 6,371,004 | B1 | 4/2002 | Peterson | 89/145 |
| 6,487,809 | B1 * | 12/2002 | Gaber | 42/119 |
| 6,643,969 | B1 * | 11/2003 | Avizonis, Jr. | 42/118 |
| 6,813,855 | B2 * | 11/2004 | Pinkley | 42/120 |
| 7,065,916 | B2 * | 6/2006 | Ballard | 42/118 |
| 7,140,142 | B2 * | 11/2006 | Ballard | 42/118 |

* cited by examiner

*Primary Examiner*—Michelle Clement
(74) *Attorney, Agent, or Firm*—Fredric J. Zimmerman

(57) ABSTRACT

The present invention comprises a reflective surface used in conjunction with an aiming device that provides the user targeting information on a surface directly on the aiming device. The reflective surface is moveably mounted directly behind the aiming device, where a user's eye would normally be positioned. In this configuration, a user, positioned at a point not directly behind the aiming device or system being used, may move the mirror to an angle appropriate to see where the system is being aimed, as indicated, on the surface of the aiming device.

17 Claims, 3 Drawing Sheets

AIMING DEVICE

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

1. Field of the Invention

The present invention pertains to aiming devices or systems, more particularly to devices placed upon equipment such as weapons, cameras, medical devices, antenna dishes, robots, etc. in order to ensure that these devices are aimed at a particular target, and most particularly to aiming devices or systems wherein the operator of the device cannot dispose themselves directly behind the device.

2. Description of the Related Art

Many aiming devices have been developed, particularly for aiming weapons such as rifles, in order to more accurately aim a system at a target. Early aiming devices consisted of metal posts attached to the tops of firearms in order for the user of the firearm to "line-up" the shot. Later developed aiming devices include telescopic sights, some of which provide laser light which directly contacts the target. One example of such a aiming device is disclosed in U.S. Pat. No. 6,371,004, which describes a bore sighting assembly that utilizes a laser beam directed at a target. However, one inherent problem in using such devices in the field is that in bright light, the user has difficulty in seeing the laser light on the target.

One solution to this problem was the development of devices that utilize mirrors or holograms in conjunction with laser light to provide a projection of where the laser light would contact a target without actually projecting the light to the target. Examples of such devices include U.S. Pat. No. 5,383,278 which discloses a sight for aiming an arrow propelled by a bow comprising a light source and a lens that reflects the light source to the users eye; U.S. Pat. No. 5,369,888 which discloses a gunsight comprising a light source and an adjustable lens to reflect the light source back to the shooter's eye; and U.S. Pat. No. 5,483,362 which discloses a holographic sight comprising of a light source that illuminates a hologram showing a point of light where the user is aiming their system. One problem associated with all of the above described aiming systems is that the user must have the ability to be directly behind the aiming device in order to effectively use the device. However, there are many instances when a system's user cannot obtain such a perspective. For instance, users wearing personal protective suits may not be able to easily bend at the waist or position their aiming eye directly in line with a device or weapon system. Military or police users also could benefit from the ability to aim a weapon around corners without placing their heads directly behind the weapon and be exposed to an enemy or potential threat.

Therefore, it is desired to provide an improved aiming device that can be easily attached to numerous systems in order to aim the system at a target in bright light and from a perspective other than directly behind the system.

SUMMARY OF THE INVENTION

The present invention is an improvement to current aiming devices, normally used in conjunction with weapons such as firearms, that allows the user to aim the weapon, using the aiming device, without being directly behind the weapon. Present aiming devices require the user to be directly behind the aiming device, normally attached to the top of a weapon, in order to aim at a target or the aiming device uses a light beam that projects directly onto the target. Under certain types of circumstances, both types cannot be used. For instance, if the user is wearing bulky, protective clothing and cannot position their head correctly or bend at the waist, a user cannot use a standard aiming device for a system mounted on a tripod at waist level. Also, if the aiming device projects a light beam, in bright light conditions such a beam is very difficult to see. In addition, some projected light beams may also present health risks if directed at a human eye.

Accordingly, it is an object of this invention to provide an improved aiming device that can operate in bright light.

It is a further object of this invention to provide an improved aiming device that allows a user to aim a weapon or other system at a target without being directly behind the weapon or system.

This invention accomplishes these objectives and other needs related to aiming devices by providing an improved aiming device comprising a reflective surface used in conjunction with an aiming device that provides the user targeting information on a surface directly on the aiming device. The reflective surface is moveably mounted directly behind the aiming device, near where a user's eye would normally be positioned. In this configuration, a user, positioned at a point not directly behind the aiming device or system being used, may move the reflective surface to an angle appropriate to see where the system is being aimed on the surface directly on the aiming device. The reflective surface may be fully rotatable in three dimensions for the greatest flexibility and may be used in conjunction with multiple reflective surfaces or magnifying lenses for specialized operations. The reflective surface and the aiming device may be mounted on a base that, in turn, can be mounted on a variety of weapons or systems that require aiming. A leveling mechanism can be added to the base to assist the user in leveling the device and ensuring proper placement of the device.

BRIEF DESCRIPTION OF THE DRAWINGS

The accompanying drawings, which are incorporated in and constitute a part of the specification, illustrate embodiments of the invention, and, together with the description, serve to explain the principles of the invention.

DESCRIPTION OF THE PREFERRED EMBODIMENT

The invention, as embodied herein, comprises an improved aiming device used in conjunction with weapons or other systems that require precision aiming. As noted above, current aiming devices are problematic to use under certain conditions or in certain situations. The present invention improves upon those devices by using an adjustable reflective surface that allows the user to use certain types of current aiming devices without being positioned directly behind the aiming devices.

In general, the invention comprises an aiming device of the type that has a surface that shows the target on a lens or other material that can be seen through. Aiming the system at the target normally only requires locating the target through the lens and lining up crosshairs or a point of light on the associated target. In order to accomplish this, the user must be directly behind the aiming device in relation to the target. The improvement comprises a reflective surface moveably mounted substantially axially with the lens or sights of the aiming device. In operation, the user, positioned at some point to the side, over, or in front of the reflective surface, moves the reflective surface in order to see the lens or other surface. This allows the user to align the weapon or other system without being directly behind the aiming device.

Figure 1:
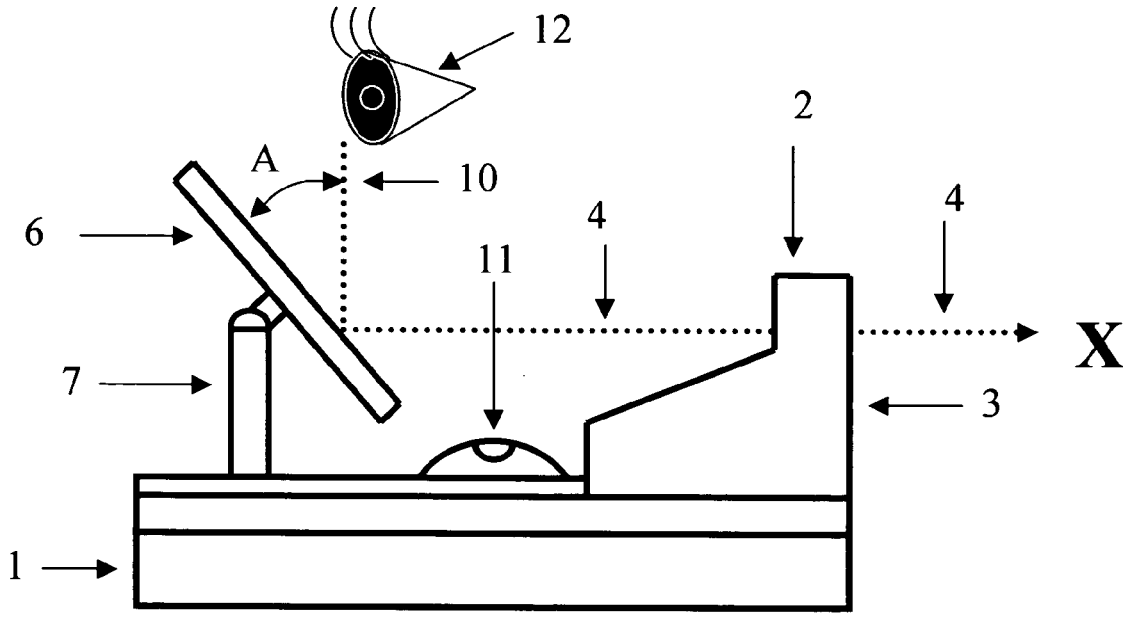
FIG. 1 shows a side view of an embodiment of the invention using a ball and socket joint as a mounting mechanism and a bubble level attached to the base.
Figure 2:
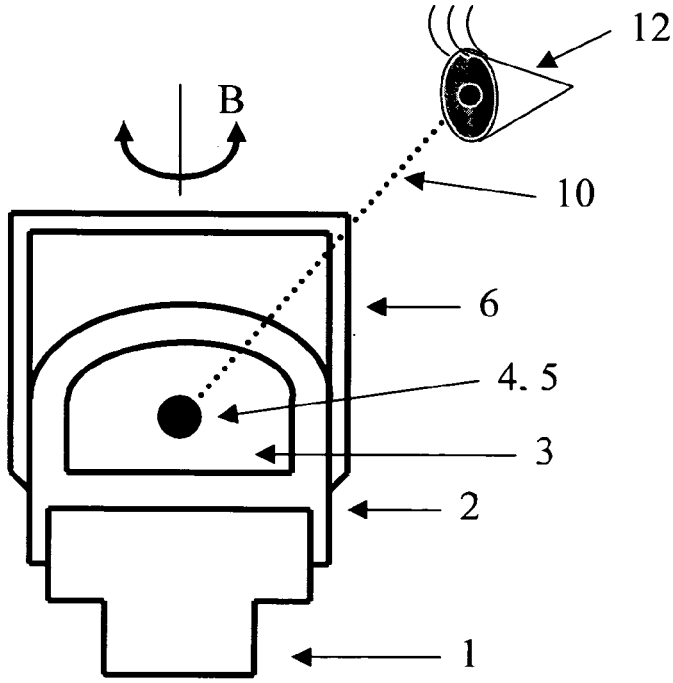
FIG. 2 shows a front view of an embodiment of the invention.

Referring to FIGS. 1, and 2, the invention comprises an aiming device 2 that has a surface 3 that a line of sight 4 passes through and indicates where the weapon or system is aimed in relation to the reference 5 of a target X; for example, a point of light. A reflective surface 6 is positioned axially in relation to the aiming device 2 and the target X. A mounting mechanism 7 is used to mount the reflective surface 6 moveably in two or three dimensions. The mounting mechanism 7 allows the user 12 to adjust the position of the reflective surface 6 at various angles to the reference 45 to obtain a line of sight 10 between the user 12 and the reflective surface 6, which allows the user 12 to see the line of sight 4 between the reflective surface 6 and the target X by seeing the reference 5. In this configuration, a user 12 may be positioned to the side, over, below, or in front of the reflective surface 6, as long as the angle A between line of sight 4 and the reflective surface 6 is between zero and ninety degrees vertically. In combination, angle B between line of sight 10 and the reflective surface 6 is between minus ninety degrees and plus ninety degrees horizontally.

In a preferred embodiment of the invention, a base 1 is included wherein the mounting mechanism 7 and the aiming device 2 are axially mounted. The base 1 preferably is planer to allow the aiming device 2 and the mounting mechanism 7 to be aligned along a plane. The mounting mechanism 7 and aiming device 2 may be mounted to the base 1 using any known fastening technique for example screws, adhesive, nails, etc. The base 1 preferably can be attached and/or removed from numerous devices that require aiming, making the improved aiming device of the present invention easily useable in many situations on many systems. The base 1 may be attached using many known fastening techniques for example screws, straps, clamps, or velcro.

In a more preferred embodiment of the invention, a leveling mechanism 11 is attached to the base 1. The leveling mechanism 11 assists the user 12 in leveling the improved aiming device and/or the system it is mounted upon. The leveling mechanism 11 can also assist in locating the top point in a system having a curved surface. One preferred leveling mechanism 11 comprises a bubble level.

The aiming device 2 should be the type that comprises a surface 3 that is normally a window or piece of glass that the line of sight 4 passes through to indicate where the system is being aimed by the reference 5. There are several known devices of this type including a cross-hair scope, a reflex gunsight, or a holographic sight. A preferred aiming device 2, portrayed in FIG. 1, is a holographic sight that uses a laser light as a source for a hologram of a reticle pattern that shows where the system is being aimed by a point of light, reference 5, on a window, surface 3.

The reflective surface 6 may be any surface that reflects the image portrayed on the surface/window 3 and may be selected by those skilled in the art. An ordinary mirror is the preferred reflective surface 6 due to low cost. The size of the reflective surface 6 may also be selected by one skilled in the art. The preferred size will be similar in size or slightly larger than the size of the surface/window 3 in order to reflect the entire area of the surface/window to the user 12.

The mounting mechanism 7 can be any type of mechanism that allows the user to move the reflective surface 6 in either two or three dimensions dependent upon the particular needs of the user 12 in order to angle the reflective surface 6 so that the user 12 may see the reference 5 on the reflective surface 6 via the line of sight 10. One example of a mounting mechanism 7, shown in FIG. 1, is a ball and socket joint configuration that allows the user 12 to change the viewing angle B so that the user 12 may view the reference 5 on the reflective surface 6. This configuration allows the user 12 to move the reflective surface 6 on two axes of rotation. A second type of mounting mechanism 7 that can be employed within the present invention is a wedge shaped block mounted to the base 1 with velcro that has the reflective surface 6 mounted thereon. This configuration allows the user 12 to move the reflective surface on one axis of rotation. These are merely two examples and one skilled in the art may select any mounting mechanism 7 that will allow the reflective surface 6 to be adjusted to accommodate a variety of viewing angles.

Figure 3:
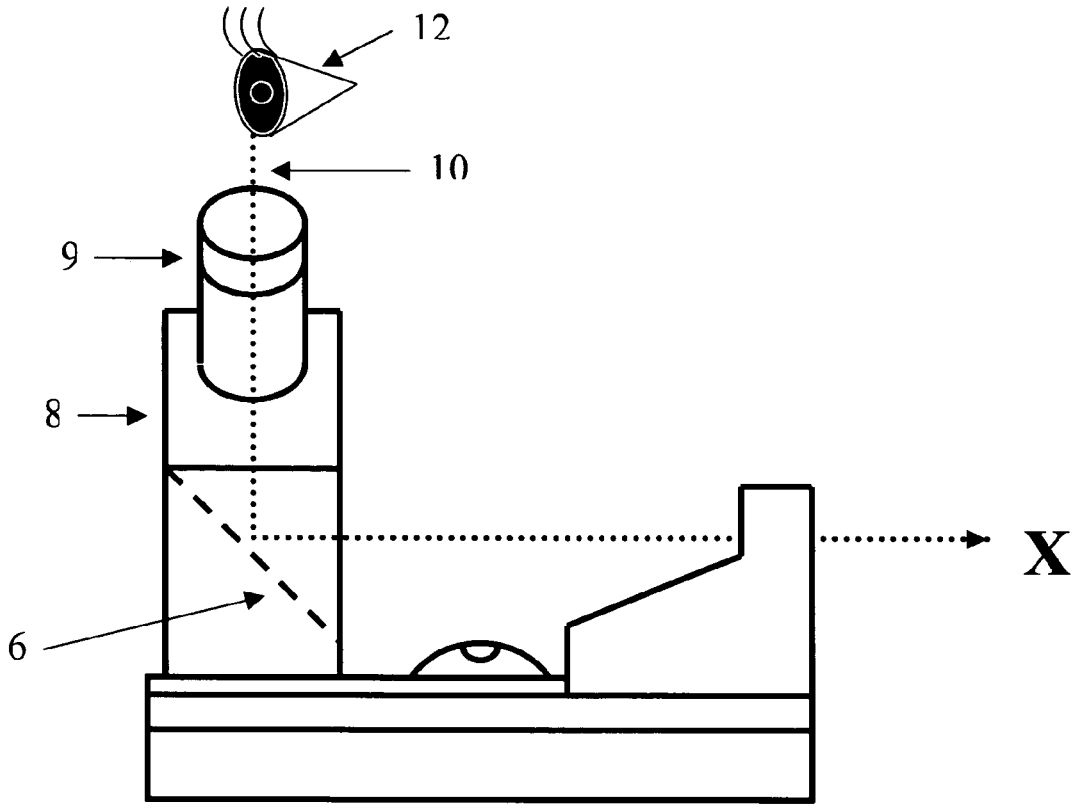
FIG. 3 shows a side view of an embodiment of the invention having multiple reflective surfaces and a magnifying lens.
Figure 4:
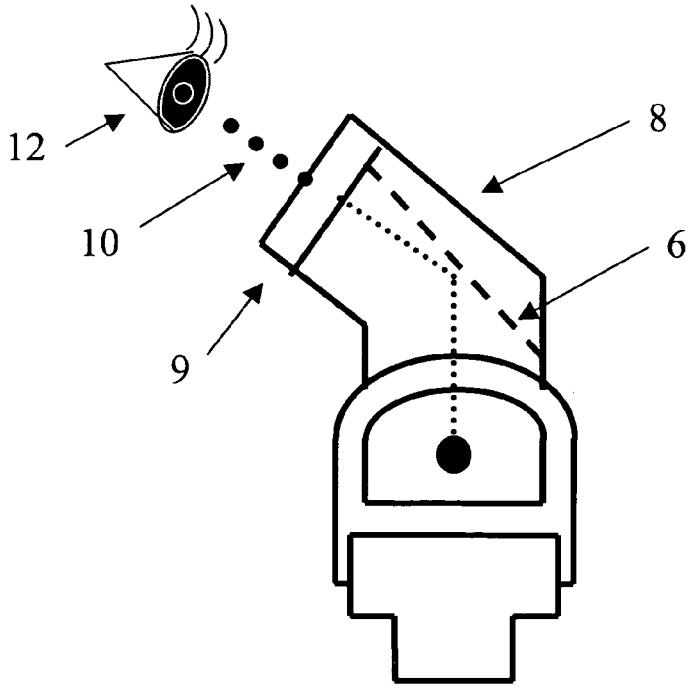
FIG. 4 shows a front view of the embodiment of FIG. 3, showing changes to visual images reflected off the multiple reflective surfaces and through the magnifying lens.
Figure 5:
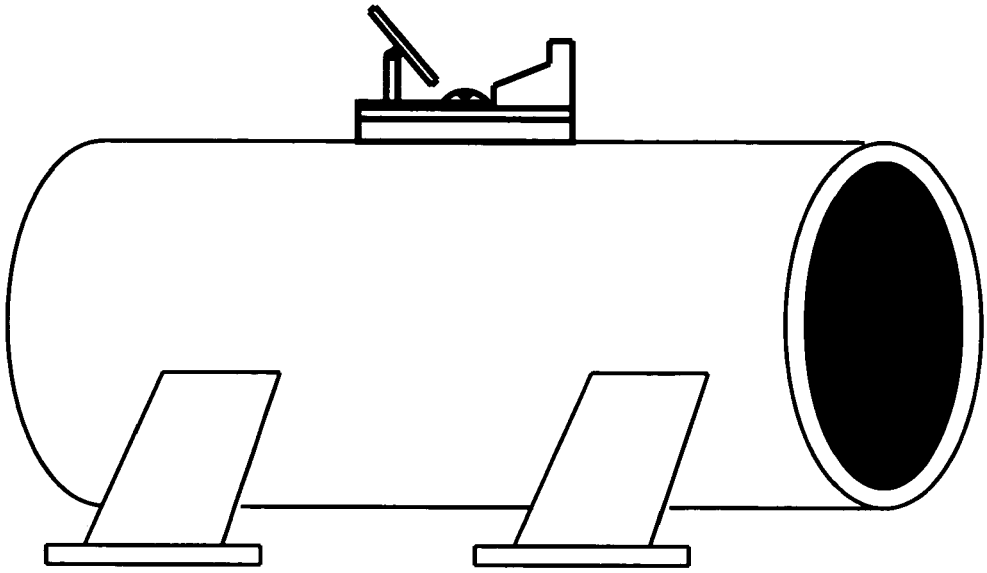
FIG. 5 shows an embodiment of the invention mounted on a weapon system.
Figure 6:
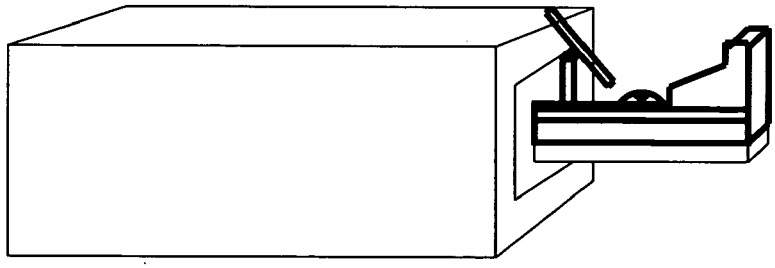
FIG. 6 shows an embodiment of the weapon mounted on a camera.

Referring to FIGS. 3 and 4, the invention 8 may also comprise reflective surfaces 6 mounted to the base 1 so that the image on the surface/window 3 reflects off the reflective surfaces 6, and, ultimately, to the user 12. The reflective surfaces 6 may be mounted to the base 1 using a mechanism similar to mounting mechanism 7 so that they can be adjusted to provide the user 12 with a variety of viewing angles. Depending upon the needs of the user 12, any suitable number of reflective surfaces 6 may be employed to allow the user to be positioned at any angle to the aiming device 2. In addition, the invention may also comprise a magnifying lens 9 positioned over the reflective surface(s) 6 that the user 12 is viewing which allows the user 12 to more clearly see the reflected image.

Finally, referring to FIGS. 1-6, the invention also comprises methods of using the device described above with weapon systems 13 or cameras 14 that require precision aiming. The basic method of use of the device comprises attaching the device to system being aimed wherein the user is not directly behind the system. The user then adjusts the reflective surface 6, using the adjustable mounting mechanism 7 until the target and the reference 4 are aligned on the reflective surface 6.

What is described are specific examples of many possible variations on the same invention and are not intended in a limiting sense. The claimed invention can be practiced using other variations not specifically described above.

What is claimed is:

1. An improved aiming device, comprising:

an aiming device comprising a holographic sight a surface showing a reference to a target; and, a reflective surface being moveably mounted substantially axially with the surface, wherein the reflective surface is moveable by a user to site the reference on the target, wherein said reflective surface is angularly adjustable at various angles to the reference, and wherein said reflective surface is mounted to a base and a mounting mechanism, said reflective surface rotates on said mounting mechanism in at least two axes in relation to said base.

2. The improved aiming device of claim 1, further comprising a base, attachable to a system to be aimed, wherein the aiming device and the reflective surface are mounted.

3. The improved aiming device of claim 1, wherein the mounting mechanism comprises a socket mounted on the base and a ball joint connected rotatably to the socket, said ball joint is also connected to the reflective surface.

4. The improved aiming device of claim 1, further comprising a leveling mechanism attached to a base.

5. The improved aiming device of claim 4, wherein the leveling mechanism comprises a bubble level.

6. The improved aiming device of claim 1, further comprising at least a second reflective surface being moveably connected to said base.

7. The improved aiming device according to claim 1, further comprising a magnifying lens mounted proximate to the reflective surface.

8. The improved aiming device according to claim 1, wherein said reflective surface is angularly adjustable at various angles within at least two axes in relation to the reference.

9. The improved aiming device according to claim 1, wherein said angles are viewing angles.

10. The improved aiming device according to claim 1, wherein the reflective surface is moveable in at least two axes.

11. The improved aiming device according to claim 1, further comprising a first line of sight between said first line of sight and said reflective surface.

12. The improved aiming device according to claim 11, wherein said first angle is between zero and ninety degrees vertically.

13. The improved aiming device according to claim 1, further comprising a second line of sight between said user and said reflective surface, wherein a second angle exists between said second line of sight and said reflective surface.

14. The improved aiming device according to claim 1, wherein said second angle is between minus ninety degrees and ninety degrees horizontally.

15. The improved aiming device according to claim 1, further comprising a first line of sight between said reflective surface and said target, and a second line of sight between said user and said reflective surface.

16. The improved aiming device of claim 1, further comprising a magnifying lens mounted proximate to the first reflective surface 17. The reflection apparatus according to claim 6, wherein said at least said second reflective surface is situated intermediate said user and said reflective surface.

* * * * *